United States Patent [19]

Ferns

[11] Patent Number: 4,936,703

[45] Date of Patent: Jun. 26, 1990

[54] FRAME FOR A COVERING FOR AN OPENING PROTECTED BY A COVER OR GRATING

[75] Inventor: Derek Ferns, Gwent, Great Britain

[73] Assignee: Van Roll AG, Gerlafingen, Switzerland

[21] Appl. No.: 149,751

[22] Filed: Jan. 29, 1988

[30] Foreign Application Priority Data

Feb. 2, 1987 [GB] United Kingdom ..... 8702224

[51] Int. Cl.[5] ..... E02D 29/14

[52] U.S. Cl. ..... 404/25; 52/20

[58] Field of Search ..... 404/25, 26; 52/19, 20, 52/21

[56] References Cited

U.S. PATENT DOCUMENTS

| | | | |
|---|---|---|---|
| Re. 8,871 | 8/1879 | Graham | 404/25 X |
| 3,217,619 | 11/1965 | Driver et al. | 404/25 |
| 3,294,000 | 12/1966 | Pelsue | 404/25 X |
| 3,611,889 | 10/1971 | Levinson | 404/26 |
| 4,029,425 | 6/1977 | Pelsue | 404/25 |
| 4,143,988 | 3/1979 | Arment | 404/26 |
| 4,475,844 | 10/1984 | Arntyr et al. | 404/25 X |
| 4,544,302 | 10/1985 | Farrelly | 404/26 X |
| 4,592,674 | 6/1986 | Baliva | 404/25 |
| 4,737,220 | 4/1988 | Ditcher et al. | 404/25 X |

FOREIGN PATENT DOCUMENTS

| | | | |
|---|---|---|---|
| 50574 | 7/1974 | Australia | 404/25 |
| 86480 | 5/1977 | Australia | 52/20 |
| 10387 | 4/1911 | United Kingdom | 404/25 |
| 707682 | 4/1954 | United Kingdom | 404/25 |

*Primary Examiner*—Stephen J. Novosad
*Assistant Examiner*—Matthew Smith
*Attorney, Agent, or Firm*—Helfgott & Karas

[57] ABSTRACT

A frame for a manhole comprises a cylindrical pipe portion and an outwardly projecting lateral flange portion located on the outside of the pipe portion. Projections are provided on the inside of the portion and on these can be supported a cover or grating. The flange portion is constructed as a cohesive collar, which projects substantially horizontally outwards. The flange portion is located at a height below the upper border of the pipe portion. This height is a third to a half of the total height of the pipe portion. Due to the fact that the flange portion is spaced from the upper end of the pipe portion, during the installation of the frame, it is surrounded at all sides by the material of the ground surface, so that the frame is connected in stable manner to the ground material and cannot be significantly displaced by the traffic flow.

12 Claims, 3 Drawing Sheets

FRAME FOR A COVERING FOR AN OPENING PROTECTED BY A COVER OR GRATING

The invention relates to a frame of a covering for an opening by a cover or grating mounted in the frame, the frame being constructed as a pipe section, length or portion with a substantially vertical axis and forms a border for the opening.

The invention relates to road or highway accessories, which include shaft coverings for covering shafts, sewers and drains. However, such coverings can also be used on squares, in courtyards and in the floors of buildings, where they are used for protecting manholes, inspection shafts and the like. Numerous constructions for such coverings are known and they essentially comprise a frame and a cover or grating inserted in the frame. The frame can in particular be constructed in numerous different ways and this is in particular a function of the place of use. The frame essentially comprises a pipe length with a substantially vertically directed pipe axis, on which is arranged a mounting support for the cover or grating. The cross-section of the pipe length can be circular, oval, quadratic, rectangular, triangular, etc.

Independently of the frame cross-section, the problem arises of reliably fitting the frame in the surrounding ground or floor area in which a way that it is so-to-speak positively connected to the latter. In the known frames, a border is generally provided at the upper end of the pipe length. This ground-flush border suffers from the disadvantage that the frame rests on the surrounding ground or floor, so that it "floats", which does not permit a reliable connection to the surrounding floor or ground.

The problem of the present invention is to so further develop a frame of the afore-mentioned type, that the pipe length of the frame can be simply laid in the ground and a reliable connection with the surrounding ground area is achieved.

According to the invention this problem is solved in that on the outer face of the pipe length is provided at least one outwardly projecting border portion, which is remote from the upper end of the pipe length. Due to the fact that the border portion is not located on the upper border of the pipe length, it is ensured that the collar can be shaped in a random manner and in addition a reliable connection with the surrounding ground area is achieved.

Figure 1:
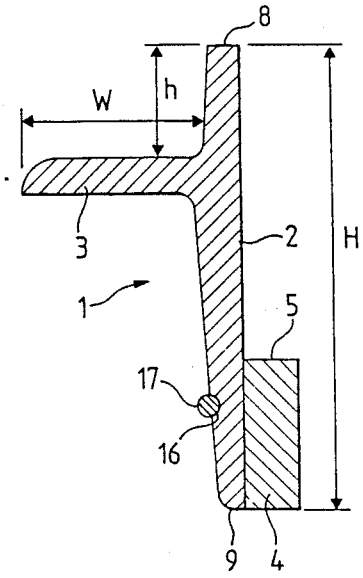

The invention is described in greater detail hereinafter relative to an embodiment and the attached drawings, wherein show:

FIG. 1 A diagrammatically represented, partial section through a frame for a covering.

Figure 2:
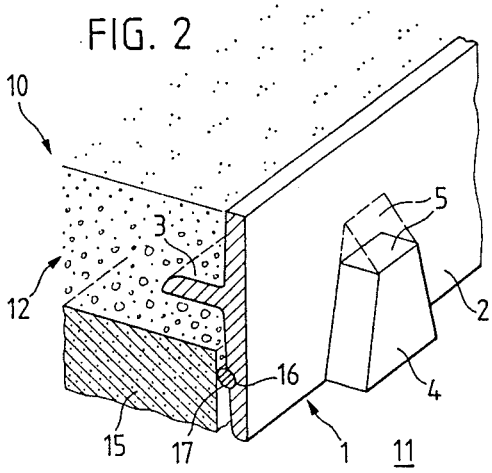

FIG. 2 A diagrammatically represented partial view of the frame according to FIG. 1 in a three-dimensional representation.

Figure 3:
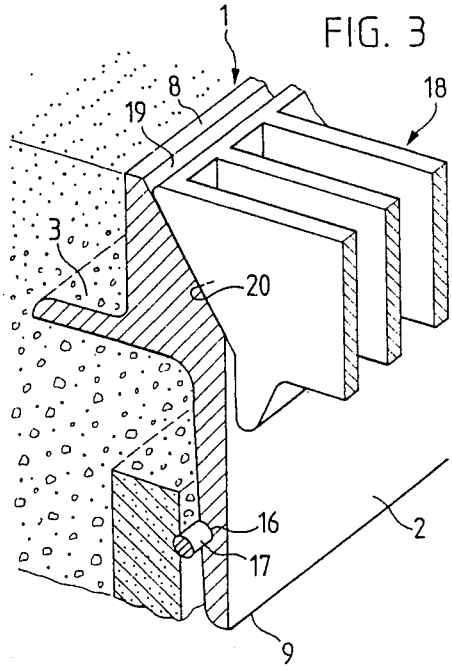

FIG. 3 A diagrammatically represented partial view of another frame in three-dimensional form and which is suitable for supporting a cover or grating.

Figure 4:
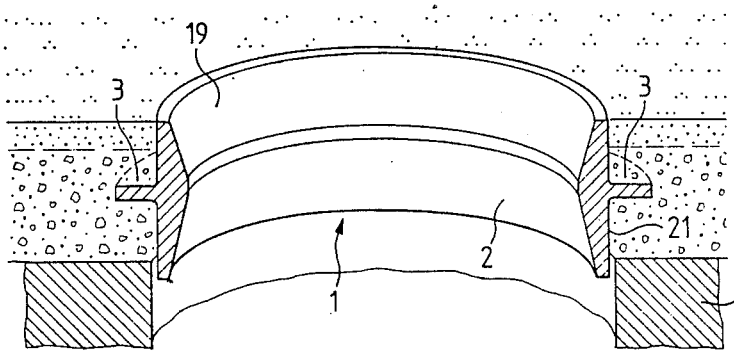

FIG. 4 A diagrammatically represented cross-section through a further frame for a covering.

Figure 5:
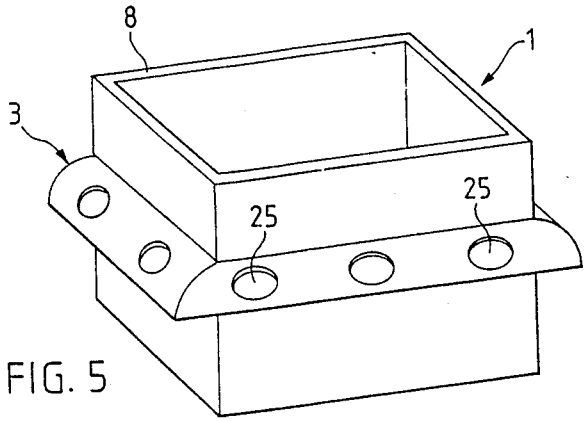

FIG. 5 A diagrammatically represented view of a rectangular frame.

Figure 6:
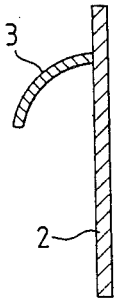

FIG. 6 A diagrammatically represented section of the side wall of the frame according to FIG. 5.

Figure 7:
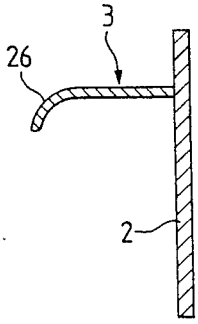

FIG. 7 A variant of the sidewall according to FIG. 6.

Figure 8:
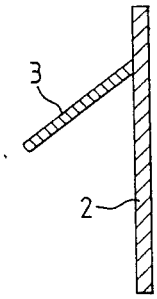

FIG. 8 Another variant of the side wall according to FIG. 6.

Figure 9:
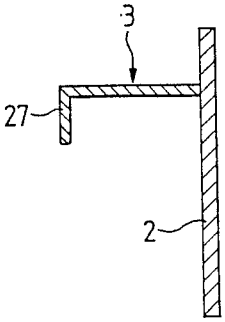

FIG. 9 A third variant of the side wall according to FIG. 6.

Figure 10:
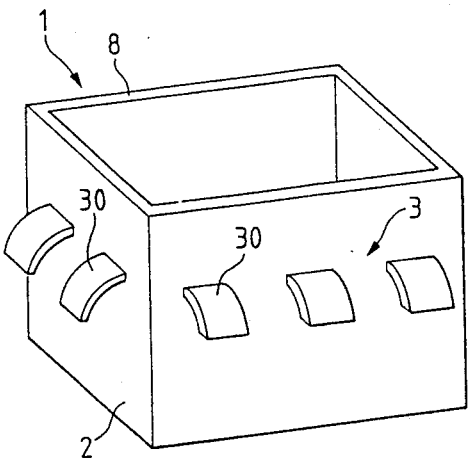

FIG. 10 A diagrammatically represented view of a further rectangular frame in three-dimensional form.

Figure 11:
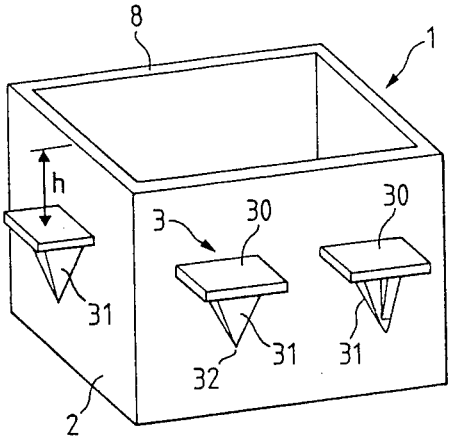

FIG. 11 A diagrammatically represented view of a third rectangular frame in three-dimensional form.

Figure 12:
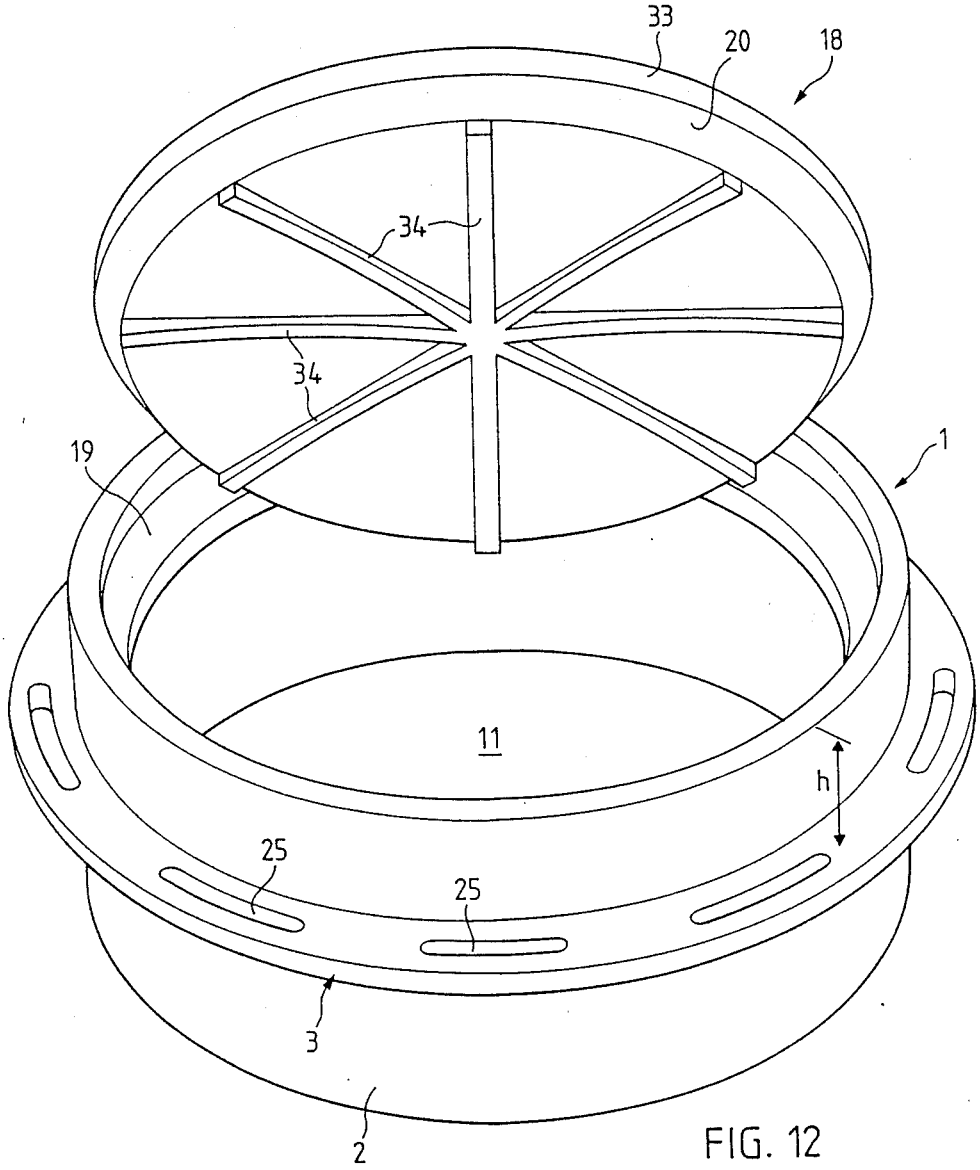

FIG. 12 A view of a frame for a covering with a support for a cover or grating in three-dimensional form.

The frame partly shown in FIG. 1 is part of a rectangular or circular frame, which comprises a correspondingly shaped pipe section or length 2 and a collar 3 arranged on the outside of the latter. On the substantially vertically directed inner wall are provided a plurality of projections 4 (only one shown), on which can be supported a not shown cover or grating. For this purpose, projection 4 is provided on its top with a bearing surface 5, which is horizontally directed in FIG. 1. However, bearing surface 5 can also be inclined, as indicated by the broken line in FIG. 2.

The collar 3 arranged on the outside of pipe length 2 essentially extends horizontally and is positioned between the upper edge or border 8 and the lower edge or border 9 of the pipe length 2. In FIG. 1, collar 3 is positioned from the upper border 8 by a distance of about one third of the height h of pipe length 2. Appropriately the distance h from collar 3 to the upper border 8 is approximately 0.2 to 0.8 H. The width W of collar 3 can also vary, but is appropriately no more than half of the total height H of pipe length 2.

FIG. 2 shows the installation of frame 1 in an artificially laid ground surface 10, e.g. in a roadway. The opening 11 bordered by frame 1 and e.g. constituted by a shaft is either surrounded by a concrete layer 12 or by a layer of blocks 15. In order to seal the shaft with respect to the layer surrounding frame 1 a peripheral groove 16 is made on the outside of pipe length 2, in which is placed a soft packing ring 17, e.g. an O-ring. The function of the soft packing ring 17 is to prevent the penetration of moisture from the shaft with respect to opening 11.

If frame 1 is placed in the ground 10, which can e.g. comprise a layer of asphalt, concrete or some other material, said layer can extend both above and below collar 3, so that the frame is securely held. Due to the fact that the collar 3 is located below the upper border 8, installation, removal and matching of the frame are relatively simple. As the frame 3 is completely surrounded on all sides by the ground material, frame 1 is held securely in the ground, so that there is only a very limited risk of it being damaged by traffic.

In FIG. 3 the frame 1 has a shape differing from that of FIGS. 1 and 2. The upper border 8 is set back with respect to the lower border 9 and passes into an inclined bearing surface 19, on which can be supported a grating or cover 18, which can have a correspondingly inclined contact surface 20 in the same way as bearing surface 19. The collar 3 located on the outside is below the upper border 8 by approximately one third of the total height of the pipe length. Here again, a groove 10 is provided for receiving a soft packing ring 17. Here again, the collar 3 is surrounded by the ground material on all sides. The further frame 1 shown in FIG. 4 has a downwardly and inwardly inclined bearing surface 19, on which is supported the contact surface of a not shown cover. As the pipe length 2 is constructed on the outside as a straight cylinder 21, the lower part of the inner wall of pipe length 2 has a downwardly and outwardly inclined shape. The collar 3 is in the present case positioned roughly in the centre of the height of pipe length 2. The lower part of frame 1 is fitted into masonry, whilst collar 3 is located in the roadway material, which is located above and below collar 3. Here again, the frame is reliably held in the roadway material, so that easy displacement thereof is not possible even in the case of a heavy traffic flow. If the frame 1 has to be removed for maintenance purposes, this is possible without major changes having to be made to the roadway.

In the diagrammatically represented frame of FIG. 5, the pipe length 2 is a substantially rectangular, hollow box, which has the outwardly projecting collar 3. Collar 3 is located approximately one third of the total height below the upper border 8 and has a plurality of passages 25.

As can be gathered from FIG. 6, which is a section through the wall 2 of frame 1 according to FIG. 5, collar 3 is provided with a downwardly directed, outwardly convex profile, through which the anchoring in the ground material is improved. Asphalt, ballast or liquid concrete and other road material can be introduced through the passages 25. The convex, rounded profile of collar 3 is an advantage both at the time of the initial installation and when fixing frame 1 with regards to traffic loading.

FIGS. 7, 8 and 9 show variants for the construction of collar 3, which is arranged on the outside of pipe length 2 in place of the collar shown in FIG. 5. In FIG. 7 the projecting collar is substantially horizontal and only has on its outermost part of its free end a downwardly projecting portion 28. In FIG. 8 the collar 3 has a straight profile, but this is downwardly inclined in roof-like manner. The collar 3 according to FIG. 9 extends substantially horizontally, a portion 27 of said collar being vertically downwardly directed.

FIG. 10 shows a frame 1 with a rectangular pipe length 2. The collar 3 is subdivided into individual portions and has grip-like flaps or tabs 30, which essentially have the same profile as collar 3 in FIG. 6. The grip-like flaps 30 can be either cast together with the pipe length 2, or produced in a separate manner and then welded, screwed or riveted to the outside of pipe length 2.

The frame 1 shown in FIG. 11 also has a rectangular or parallelepipedic pipe length 2 and much as in FIG. 10 the collar 3 is subdivided into individual, spaced flaps 30. In the construction according to FIG. 11 flap 30 is directed horizontally outwards, being arranged at height h below the upper border 8 of frame 1. Downwardly and inwardly inclined flanks 31 are fixed to the underside of flaps 30 and pass out in conical or pyramidal manner to form a tip 32. Thus, the pipe length 2 can be easily pressed downwards into the ground material, whilst the substantially horizontal flaps 30 lead to an effective anchoring of frame 1 in the ground material on filling the road material. The conical or pyramidal flanks 31 can either be made from one piece or formed from several pieces, both constructions being shown in FIG. 11.

FIG. 12 shows a complete covering with a frame 1 and a cover or grating 18. The pipe length 2 is a circular cylindrical hollow body having a bearing surface 19 on its inside, which is inwardly and downwardly inclined.

Opening 11 is protected by a cover in FIG. 12, but this can also be provided with openings and then constitutes a grating. Below a substantially vertical circumferential border 33, on the underside of the cover or grating 18 is provided a downwardly and inwardly inclined contact surface 20, which is supported on bearing surface 19 and cooperates therewith. Radially directed ribs 34 are provided on the bottom of the cover or grating 18 and serve to reinforce the latter. On the outside of pipe length 2 is provided a collar 3 at a height h of approximately one third of the total height of pipe length 2. Collar 3 has an outwardly projecting horizontal or convex profile and has a plurality of circumferentially distributed passages 25. The collar 3 according to FIG. 12 is of the type used in FIGS. 1, 5 or 7 for a rectangular pipe length 2.

I claim:

1. A frame for a manhole, insertable in a vertical hole formed in a ground surface layer, the frame comprising a pipe-shaped main frame element formed to provide a support for a grating or cover and set into a surrounding ground surface material with an upper edge thereof substantially flush with a ground surface level, said frame element including a lateral flange element projecting outwards from said main frame element in a direction transversal to an axis of said main frame element and at a level intermediate upper and lower extremities thereof, said lateral flange element being embedded in said ground surface material and holding said main frame element against upward and downward movement, wherein said lateral flange element is located at a vertical level h below the upper edge of the main frame element, such that h is between 0.2H and 0.8H, where H is the overall height of the main frame element.

2. A frame according to claim 1, in which said lateral flange element is rigidly fixed to said main frame element.

3. A frame according to claim 1, wherein said lateral flange element projects substantially horizontally.

4. A frame according to claim 1, wherein said lateral flange element is at least partly downwardly directed.

5. A frame according to claim 1, wherein said lateral flange element has a plurality of openings.

6. A frame according to claim 1, wherein said lateral flange element comprises a plurality of spaced-apart projections.

7. A frame according to claim 6, wherein each of said spaced-apart projections is provided with downwardly inclined undersurfaces.

8. A frame according to claim 1, wherein an upper part of said main frame element is a vertical continuation of a lower part thereof.

9. A frame according to claim 1, wherein a lateral width W of said lateral flange element is greater than a vertical distance of said flange element to the upper edge of the main frame element but not less than H/2 where H is the overall height of the main frame element.

10. A frame according to claim 1, wherein the overall height of said main frame element is less than D/2 where D is the maximum transverse horizontal dimension of said main frame element.

11. A frame for a manhole insertable in a vertical hole formed in a ground surface layer, the frame comprising a pipe-shaped main frame element formed to provide a support for a grating or cover and set into a surrounding ground surface material with an upper edge of the frame element substantially flush with a ground surface level, said frame element including a lateral flange portion projecting outwards from said frame element in a direction transversal to an axis of said frame element and at a level intermediate between upper and lower extremities thereof, said lateral flange portion being embedded in said ground surface material and holding said main frame element against upward and downward movement, said flange portion being formed by a plurality of juxtaposed horizontally projecting plates spaced from each other and each provided with a downwardly tip, wherein said tip is conical.

12. A frame for a manhole insertable in a vertical hole formed in a ground surface layer, the frame comprising a pipe-shaped main frame element formed to provide a support for a grating or cover and set into a surrounding ground surface material with an upper edge of the frame element substantially flush with a ground surface level, said frame element including a lateral flange portion projecting outwards from said frame element in a direction transversal to an axis of said frame element and at a level intermediate between upper and lower extremities thereof, said lateral flange portion being embedded in said ground surface material and holding said main frame element against upward and downward movement, said flange portion being formed by a plurality of juxtaposed horizontally projecting plates spaced from each other and each provided with a downwardly narrowing tip, wherein said tip is pyramidal.

* * * * *